US007387068B2

(12) United States Patent
Yip

(10) Patent No.: US 7,387,068 B2
(45) Date of Patent: Jun. 17, 2008

(54) METHODS OF MAKING MULTI-COLOR INK STAMPS

(75) Inventor: Doogong Yip, Green Brook, NJ (US)

(73) Assignee: Trodat GmbH (AT)

( * ) Notice: Subject to any disclaimer, the term of this patent is extended or adjusted under 35 U.S.C. 154(b) by 0 days.

(21) Appl. No.: 11/501,658

(22) Filed: Aug. 9, 2006

(65) Prior Publication Data

US 2006/0266239 A1 Nov. 30, 2006

Related U.S. Application Data

(63) Continuation of application No. 10/627,911, filed on Jul. 25, 2003.

(60) Provisional application No. 60/437,962, filed on Jan. 3, 2003.

(51) Int. Cl.
*B41F 31/00* (2006.01)
*B41K 1/38* (2006.01)

(52) U.S. Cl. ..... 101/321; 101/125; 101/171; 101/333; 101/405

(58) Field of Classification Search ..... 101/125, 101/171, 325, 333, 372
See application file for complete search history.

(56) References Cited

U.S. PATENT DOCUMENTS 3,227,079 A 1/1966 Muskin
3,282,209 A * 11/1966 Muskin ..... 101/373
3,442,209 A 5/1969 Funahashi
3,446,143 A 5/1969 Williamson
3,478,682 A 11/1969 Funahashi
3,988,987 A 11/1976 Ikura et al.
4,625,640 A 12/1986 Bunger
5,471,930 A 12/1995 Wood
5,505,130 A 4/1996 Winston
5,531,829 A 7/1996 Yasoshima
5,577,444 A 11/1996 Toyama
5,586,500 A 12/1996 Takami et al.
5,601,644 A 2/1997 Yasoshima
5,636,569 A 6/1997 Winston (Continued)

FOREIGN PATENT DOCUMENTS

JP 60244585 * 12/1985
JP 2000280590 * 10/2000
JP 2004114444 * 4/2004

*Primary Examiner*—Daniel J. Colilla
*Assistant Examiner*—Marissa Ferguson-Samret
(74) *Attorney, Agent, or Firm*—Lerner, David, Littenberg, Krumholz & Mentlik, LLP

(57) ABSTRACT

A method of making an ink stamp includes providing a first porous structure having a top surface, a bottom surface and porous edges extending between the top and bottom surfaces, loading a first ink into the first porous structure, and providing a second porous structure having a top surface, a bottom surface and porous edges extending between the top and bottom surfaces. The method includes loading a second ink into the second porous structure, applying energy to one of the porous edges of the first porous structure to transform the porous edge to an edge having a non-porous surface, and assembling the first porous structure with the second porous structure so that the non-porous edge of the first porous structure is in direct contact with one of the porous edges of the second porous structure. The non-porous edge prevents the first ink from passing through the non-porous edge to the second porous structure.

19 Claims, 7 Drawing Sheets

U.S. PATENT DOCUMENTS 5,653,804 A 8/1997 Yasoshima
5,655,451 A 8/1997 Wasylczuk et al.
5,865,892 A 2/1999 Yasoshima
5,870,953 A 2/1999 Winston
6,000,335 A 12/1999 Imamaki et al.
6,047,639 A 4/2000 Shih
6,119,596 A 9/2000 Fletcher et al.
6,289,806 B2 9/2001 Hirano
6,460,456 B1 * 10/2002 Sugiyama et al. ..... 101/327
6,634,288 B1 * 10/2003 Imamaki et al. ..... 101/125

* cited by examiner

METHODS OF MAKING MULTI-COLOR INK STAMPS

CROSS REFERENCE TO RELATED APPLICATIONS

The present application is a continuation of U.S. patent application Ser. No. 10/627,911, filed Jul. 25, 2003, which claims the benefit of U.S. Provisional Application No. 60/437,962, filed Jan. 3, 2003.

BACKGROUND OF THE INVENTION

The present invention generally relates to ink stamping devices useful for making ink impressions on items such as papers, envelopes and cardboard containers. More particularly, the present invention relates to a multi-color stamping device having two or more adjacent pre-inked marking structures containing different color inks, whereby at least one of the marking structures has a non-porous edge for preventing migration of ink between two adjacent marking structures. The present invention also relates to methods and devices for properly assembling a composite marking structure.

Hand stamps having pre-inked marking structures enable a user to create numerous impressions without introducing additional ink into the marking structure. The pre-inked marking structures have microscopic pores that allow the ink initially retained within the marking structure to escape at a controlled rate. One high quality, pre-inked hand stamp is manufactured and sold under the trademark ROYAL MARK by M&R Marking Systems Inc. of Piscataway, N.J. These pre-inked hand stamps include marking structures made using a gel comprising a mixture of thermoplastic resin and ink, which is commonly referred to as a pre-mix.

There are a variety of methods for manufacturing microporous marking structures. In one method, the pre-mix, which includes a desired quantity of ink, is poured into a mold. The mold is then heated in a vulcanizer at a predetermined pressure and temperature for a selected period of time. When the pressure, temperature and time parameters have been satisfied, the marking structure is formed into a microporous slab. The marking structure is then removed from the mold and any excess ink in the structure is removed during a stabilizing process. The marking structure has a resilient microporous network that contains ink, which is released through protruding indicia of a molding when pressed against a surface to be marked.

Another well known method of manufacturing microporous marking structures includes initially forming a microporous structure that does not contain ink. Such microporous marking structures may be manufactured by sintering, salt-leaching or other methods. This type of microporous marking structure is impregnated with ink during a separate procedure which may involve immersing the microporous marking structure in an ink pool, subjecting the microporous marking structure and ink to a vacuum environment or other known methods. With this type of microporous marking structure, it is generally necessary to stabilize the structure, i.e. remove excess ink therefrom, prior to assembly of the marking structure on a hand stamp mount.

Another type of pre-inked stamp uses a microporous foam upon which an image is flash printed. One flash exposure system for manufacturing pre-inked hand stamps is described at M&R Marking System Inc.'s Website at www-.mrmarking.com and is provided under the trademark ULTIMARK. In general, the ULTIMARK system comprises a computer controlled flash irradiation device which exposes select areas of foam text plates (i.e. marking structures that have been formulated to be used in pre-inked hand stamps) to a high energy light source for a period of time. A protective film is used to shield certain areas of the microporous foam so that the shielded areas are not exposed to the light source. The brief exposure to light causes the exposed surfaces of the text plate to melt creating substantially non-porous areas at the exterior surfaces of the microporous foam. The unexposed areas remain porous so that the microporous foam can be subsequently used as a marking structure in hand stamps.

In one particular embodiment of the ULTIMARK system, the flash-exposed pre-inked stamps are made by printing or imaging a positive or negative image on a transparent paper or plastic, and then placing that image on a transparent body of typically glass or plastic in between a light source and the microporous foam to be exposed. A clear protective sheet may be placed over the flash exposable microporous material and on top of a transparent indicia medium. An improved process for preparing a microporous material for flash exposure is disclosed in commonly assigned U.S. patent application Ser. No. 10/439,469, filed May 16, 2003, the disclosure of which is incorporated by reference herein.

There have been a number of efforts directed to producing ink stamps capable of printing in two or more colors. For example, U.S. Pat. No. 6,289,806 to Hirano discloses a stamp having an occlusion body with a continuous porous structure that is impregnated with two or more kinds of ink. The occlusion body includes a physical barrier that inhibits mingling of two or more kinds of ink. Although Hirano addresses the issue of color mingling, it requires the use of additional parts in the form of a physical barrier to suppress the mingling of colors.

U.S. Pat. No. 6,047,639 to Shih discloses a stamping set including at least one partition strip that separates an enclosed space into at least two rooms for separating ink of two different colors. Although the '639 patent also addresses the issue of preventing color mingling, it also requires the use of an additional component, i.e. a partition strip.

U.S. Pat. No. 5,601,644 discloses a multi-color ink stamp pad, whereby a thin, aqueous-impermeable film is disposed between the pads for preventing color mingling. Thus, the '644 patent also requires an additional part to prevent mixing of the different colored inks.

There have also been a number of efforts directed to simplifying assembly of hand stamps. For example, U.S. Pat. No. 3,988,987 to Ikura discloses a stamp frame having a vertical interlocking projection on one of its side surfaces, a vertical interlocking groove on the opposite side surface, and a holding member removably mountable over the stamp elements to prevent displacement of the stamp elements relative to one another. Although Ikura applies to ensuring proper assembly of a stamp device, it teaches a registration concept applied to a stamp frame rather than the stamp pad itself. As such, there is nothing in the disclosure indicating a registration concept on the adjacent portions of the marking structure to facilitate the assembly of marking structures on a hand stamp mount.

SUMMARY OF THE INVENTION

In accordance with certain preferred embodiments of the present invention, a hand stamp includes a first marking structure, such as a porous foam marking structure, having ink stored therein. The first marking structure has a front surface adapted to print a first ink onto an object, a rear surface and peripheral edges extending between the front and rear surfaces. The hand stamp may also include a second marking structure, such as a porous foam, having a front surface adapted to print a second ink onto an object, a rear surface and peripheral edges extending between the front and rear surfaces of the second marking structure. The first and second marking structures are preferably assembled together so that at least one of the edges of the first marking structure opposes at least one of the edges of the second marking structure. At least one of the opposing edges desirably has a non-porous surface for preventing migration of a first ink in the first marking structure with a second ink in the second marking structure.

In certain preferred embodiments, the first and second marking structures preferably comprise a microporous foam, whereby certain areas of the foam may be exposed to an energy source for generating exposed surfaces on the foam. The exposure to light causes the exposed surfaces of the microporous foam to melt creating substantially non-porous areas at the surface of the foam. The unexposed areas of the foam remain porous so that the stamped foam can subsequently be used as a marking structure in hand stamps capable of creating ink imprints. The ink in the marking structures preferably passes through the porous regions of the face surface to create an imprint. In other preferred embodiments, the first and second marking structures may comprise a mixture of thermoplastic resin and ink that are exposed to light or energy for creating a design including porous and non-porous areas.

The hand stamp of the present invention is preferably used to create prints made of two or more colors. In one preferred embodiment, the first ink in the first marking structure is a first color, such as blue, and the second ink in the second marking structure is a second color, such as red, that is different than the first color.

In certain preferred embodiments, at least one edge of the first or second marking structure has a non-porous surface. The ink may be introduced into the foam structure either before the images are exposed thereon, during image exposure or after image exposure. The ink may also be introduced either before, during or after the marking structures are cut from the foam sheets.

In other preferred embodiments of the present invention, a hand stamp includes a first marking structure having a front surface adapted to print ink onto an object, a rear surface and peripheral edges extending between the front and rear surfaces of the first marking structure, whereby at least one of the peripheral edges of the first marking structure has a first pattern. The hand stamp of this embodiment may also preferably include a second marking structure having a front surface adapted to print ink onto an object, a rear surface and peripheral edges extending between the front and rear surfaces of the second marking structure, whereby at least one of the peripheral edges of the second marking structure has a second pattern that matches the first pattern. The hand stamp is fabricated by assembling the first and second marking structures together with the first patterned peripheral edge of the first marking structure interlocking with the second patterned peripheral edge of the second marking structure so that the first and second marking structures can be assembled together in only one configuration. In this particular embodiment, the edges of the first and second marking structures may or may not be non-porous. Although the present invention is not limited by any particular theory of operation, it is believed that having opposing patterned edges that match one another will simplify the assembly process and prevent the first and second marking structures from being assembled in an incorrect configuration.

In other preferred embodiments, at least one of the interlocking first and second patterned peripheral edges has a non-porous surface for preventing ink migration between the first and second marking structures. In other preferred embodiments, the patterned peripheral edges of both marking structures are non-porous for preventing ink migration. In other preferred embodiments, the patterned peripheral edges of both marking structures are porous.

In certain preferred embodiments, the first marking structure carries an ink having a first color and the second marking structure carries an ink having a second color that is different than the first color. As such, the assembled stamp is capable of generating a print having two or more colors, with at least one non-porous edge preventing ink migration or mixing of the first and second inks.

In still other preferred embodiments of the present invention, a hand stamp includes a porous marking structure having a front surface adapted to print ink onto an object, a rear surface and peripheral edges extending between the front and rear surfaces. The porous marking structure desirably has a first region containing a first ink, a second region containing a second ink and a non-porous border extending through the marking structure for preventing the first and second inks from migrating into one another. As noted above, in this particular embodiment, the porous marking structure may include foam or may be made of a mixture of thermoplastic resin and ink. The first ink in the first region of the marking structure preferably has a first color and the second ink in the second region of the marking structure preferably has a second color that is different than the first color. These and other preferred embodiments of the present invention will be described in more detail below.

DETAILED DESCRIPTION

Figure 1:
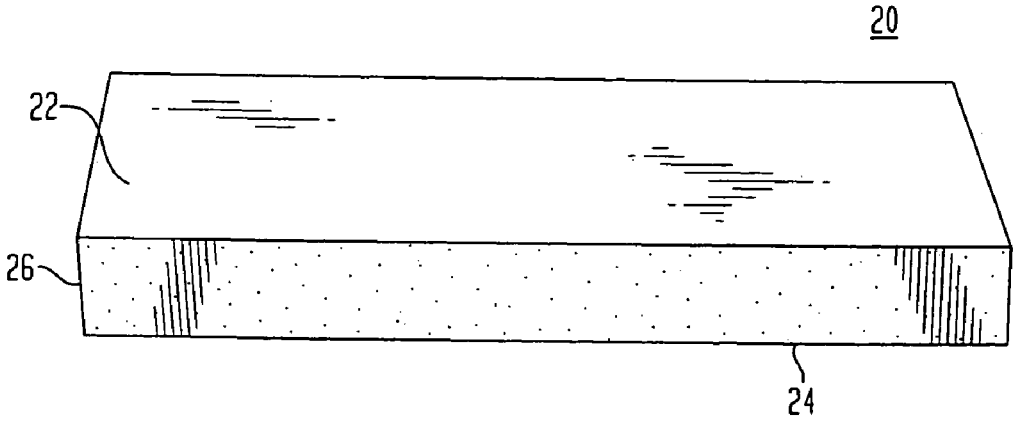
FIG. 1 shows a front view of a porous foam sheet for making marking structures, in accordance with certain preferred embodiments of the present invention.

FIG. 1 shows a microporous foam sheet 20 having a top surface 22, a bottom surface 24 remote from the top surface 22, and one or more peripheral edges 26 extending between top surface 22 and bottom surface 24. In the particular microporous foam sheet 20 shown in FIG. 1, the sheet has four edges 26 extending between top surface 22 and bottom surface 24. In other preferred embodiments, the sheet may have less than four, or more than four, edges.

Figure 2:
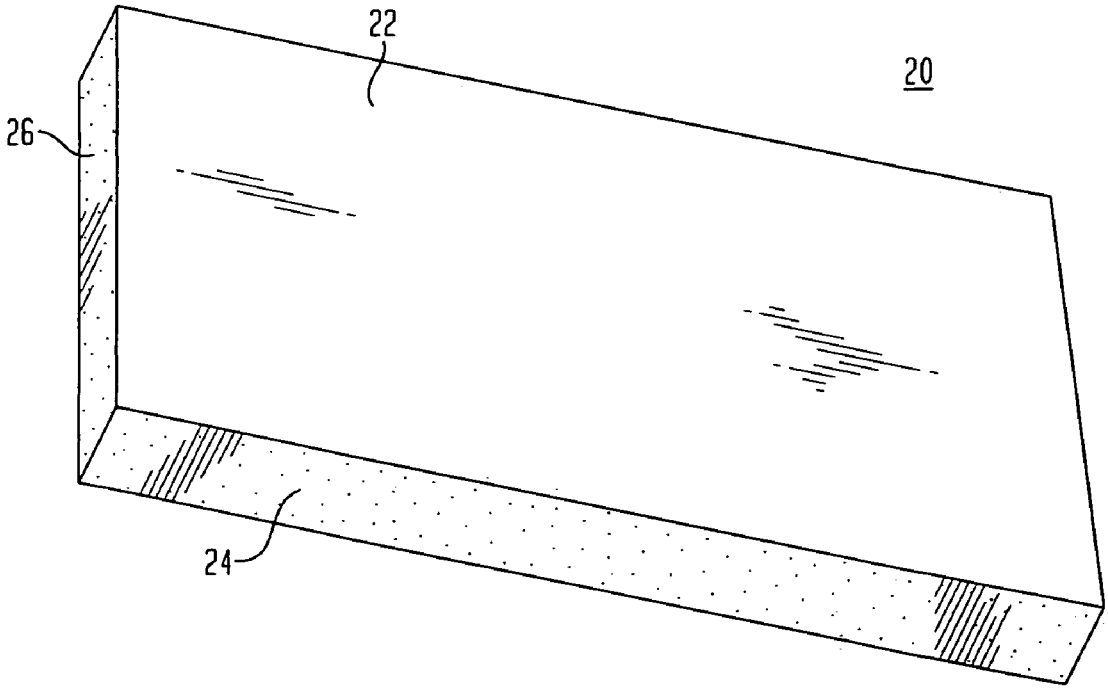
FIG. 2 shows a top perspective view of the porous foam sheet of FIG. 1.

FIG. 2 shows a perspective view of microporous foam sheet 20 including top surface 22, bottom surface 24 and one or more peripheral edges 26 extending between top surface 22 and bottom surface 24.

Figure 3:
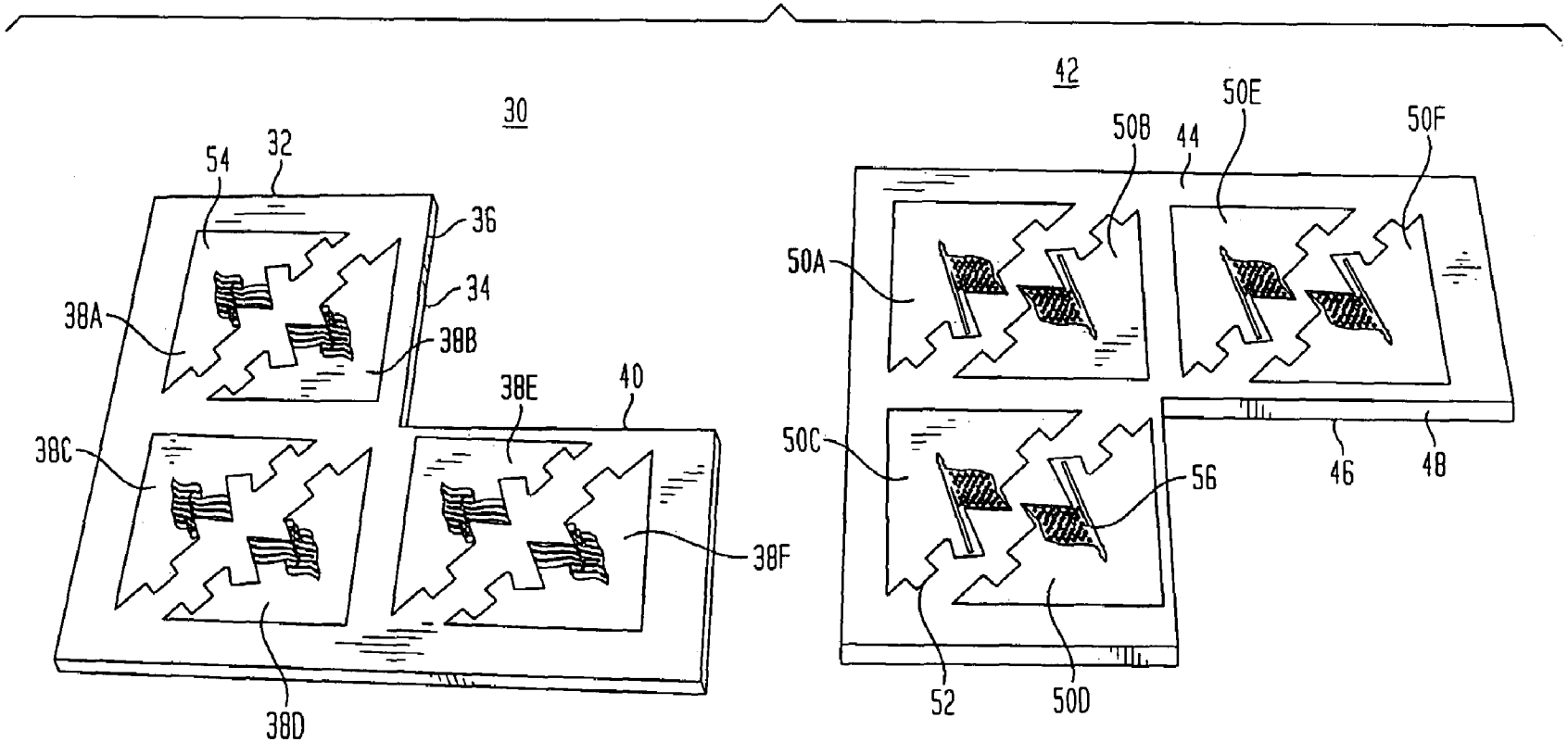
FIG. 3 shows a first foam sheet having a plurality of first marking structures formed therein and a second foam sheet having a plurality of second marking structures formed therein, in accordance with certain preferred embodiments of the present invention.

Referring to FIG. 3, a process may be used, such as that disclosed in commonly assigned U.S. Provisional Application 60/380,974 filed May 16, 2002, to form marking structures that may be loaded with ink for creating pre-inked hand stamps. In certain preferred embodiments, the microporous foam sheets of FIGS. 1 and 2 are exposed to a flash irradiation device whereby energy from a light source exposes certain areas of the foam to the light for melting the surface of the foam so as to form a non-porous area at the exterior surface of the foam. The unexposed areas of the foam remain porous so that the marking devices can be subsequently used as marking structures in hand stamps for creating imprints on surfaces such as paper, envelopes and containers. As shown in FIG. 3, a first foam sheet 30 having images flash-printed thereon includes a top surface 32 having images printed thereon, a bottom, untreated surface 34 that remains substantially porous and peripheral edges 36 that extend between the top, substantially non-porous surface and the bottom, substantially porous surface 34. A cutting device, such as a laser, may preferably be used for cutting a plurality of marking structures 38A-38F. Each marking structure 38A-38F of first foam sheet 30 is substantially similar to one another so that the first marking structures may be used as a first part of a hand stamp marking structure. Each marking structure 38 includes an edge 40 that defines a unique pattern for assembly with another marking structure, as will be described in more detail below. Each first marking structure 38A-38F is preferably cut using a laser. As the laser cuts through the first foam sheet 30, the edges of the individual marking structures 38A-38F are preferably exposed to the energy of the laser for melting the edges of the first marking structures 38. As a result, the edges are non-porous so that ink may not pass therethrough. Other cutting devices such as cutting knives, razors, dies, presses and water may also be used. In all of these other cutting methods, energy must be applied to at least one of the edges of the marking structures to form at least one non-porous edge.

FIG. 3 also shows a second foam sheet 42 having a top surface 44, a bottom surface 46 and peripheral edges 48 extending between top surface 44 and bottom surface 46. The second foam sheet 42 is treated in a similar fashion as described above with respect to first foam sheet 30, so that top surface 44 is substantially non-porous, except for the flag design, and the bottom surface 46 is substantially porous. Second marking structures 50A-50F are cut from the second foam sheet 42. The second marking structures 50A-50F are substantially similar to one another and include a unique pattern 52 preferably cut using a laser (or one of the other cutting devices listed above). As the laser cuts through the second marking structures 50A-50F, the surface of the edges are melted for forming non-porous surfaces through which ink may not pass.

In order to create a marking structure for a hand stamp, one of the first marking structures 38 from the first foam sheet 30 is assembled with one of the second marking structures 50 from the second foam sheet 42. The edge pattern 40 of the first marking structure 38 may be assembled with the edge pattern 52 of a second marking structure 50 in only one orientation. This is due to the unique patterns cut into the first and second marking structures 38, 50.

In the particular embodiment shown in FIG. 3, the first and second marking structures 38, 50 contain different portions of an American flag. The first marking structure 38 contains the stripes 54 of the American flag, while the second marking structure 50 contains the field and staff portion 56 of the American flag. The unique edge patterns 40, 52 cut into the respective first and second marking structures 38, 50 ensure that the marking structures may only be assembled together in one configuration. This avoids improper assembly as has occurred in prior art hand stamp devices. Moreover, the non-porous edges of the first and second marking structures 38, 50 prevent ink migration between the two marking structures.

In certain preferred embodiments, the first marking structure 38 is loaded with red ink so that the stripes 54 of the flag are red and white (in non-porous areas) and the second marking structure 50 is loaded with blue ink so that the field 56 of the flag is blue. After the first and second marking structures 38, 50 are assembled together, it is desirable to prevent the red ink of the first marking structure 38 from mixing with the blue ink of the second marking structure 50. As such, the non-porous edges extending between the first and second marking structures are highly desirable for avoiding mixing or migration of the ink. The non-porous edges also preclude the need for a third object, such a barrier or border, to be assembled between the two marking structures 38, 50, thereby simplifying the assembly process and minimizing the number of parts needed for assembly.

Figure 4:
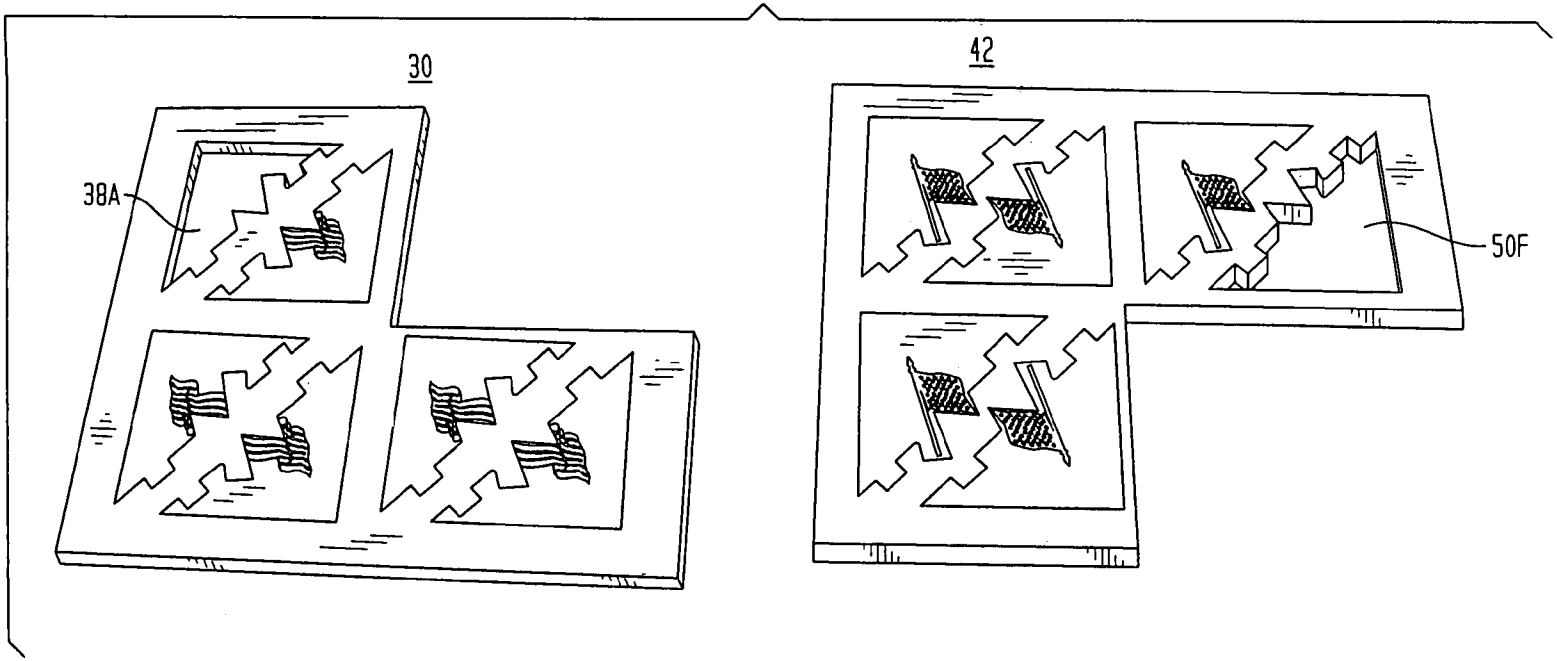
FIG. 4 shows the respective first and second foam sheets with a first marking structure removed from the first foam sheet and a second marking structure removed from the second foam sheet.

FIG. 4 shows first foam sheet 30 having one of the first marking structures 38A removed therefrom and second foam sheet 42 having one of the second marking structures 50F removed therefrom.

Figure 5:
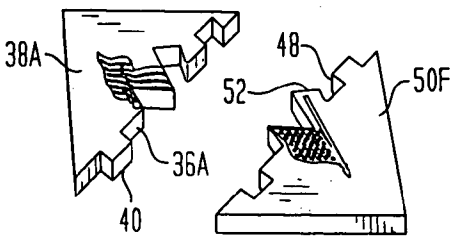
FIG. 5 shows the removed first and second marking structures of FIG. 4 aligned with one another for assembly.

Referring to FIG. 5, first marking structure 38A has a non-porous edge 36A with a pattern 40 formed therein. The patterned edge 36A preferably has a number of projections and depressions, which appear substantially similar to the edge of a puzzle piece. The second marking structure 50F has a non-porous edge 48 with a pattern 52 that matches the pattern 40 of first marking structure 38A. As such, the projections of pattern 40 of first marking structure 38A fit into the depressions of 52 of the pattern of the second marking structure 50F, and the projections of pattern 52 of second marking structure 50F fit into the depressions of pattern 40 of first marking structure 38A. As a result, the first and second marking structures 38A, 50F may be assembled together like puzzle pieces. This ensures that the first and second marking structures 38A, 50F may be assembled together in only one configuration, thereby avoiding improper assembly of the two pieces.

Figure 6:
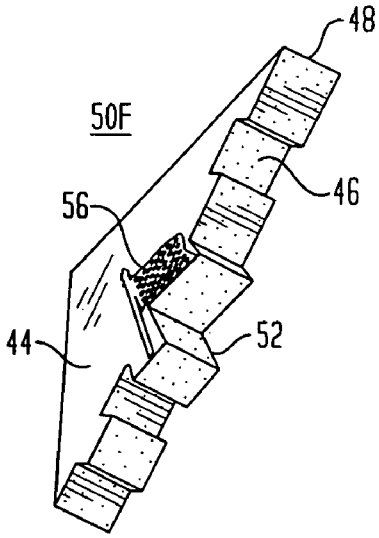
FIG. 6 shows a perspective view of a second marking structure including a non-porous edge, in accordance with certain preferred embodiments of the present invention.

FIG. 6 shows a perspective view of the second marking structure 50F having the field and staff portions 56 of an American flag formed thereon. The second marking structure 50F has a top surface 44 that is substantially non-porous, a bottom surface 46 that is substantially porous and that extends in a substantially parallel orientation with respect to top surface, and a peripheral edge 48 extending between top surface 44 and bottom surface 46. As noted above, peripheral edge 48 includes at least one edge having a pattern 52 cut therein. The patterned edge 48 is substantially non-porous, so that the ink stored in the second marking structure 50F does not migrate into a first marking structure (not shown) assembled with the second marking structure 50F. In use, the top surface or front face 44 of second marking structure 50F is pressed against a printable surface, such as paper, so that the ink stored in the second marking structure 50F passes through the microporous holes at the field design 56 formed on the top surface 44. The blue ink does not pass through the non-porous portion of the top surface 44.

Figure 7:
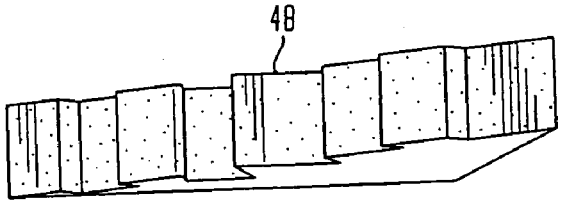
FIG. 7 shows an edge view of the second marking structure of FIG. 6.

FIG. 7 shows a magnified view of non-porous edge 48 of second marking structure 50F.

Figure 8:
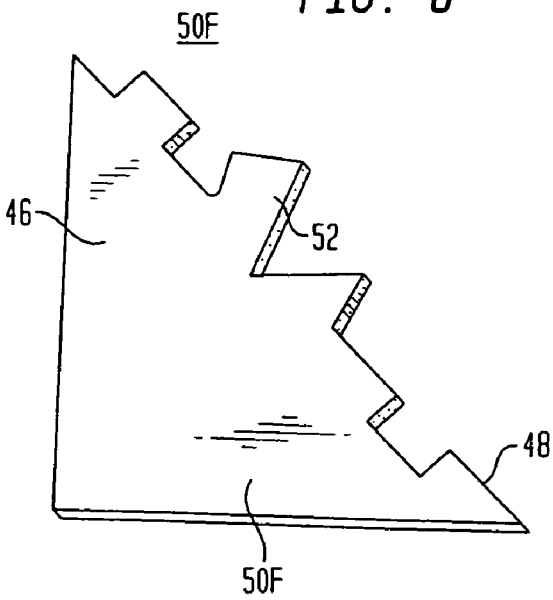
FIG. 8 shows a bottom plan view of the second marking structure of FIGS. 6 and 7.

FIG. 8 shows a bottom plan view of second marking structure 50F including substantially porous bottom surface 46 and edge 48 having pattern 52 cut therein.

Figure 9:
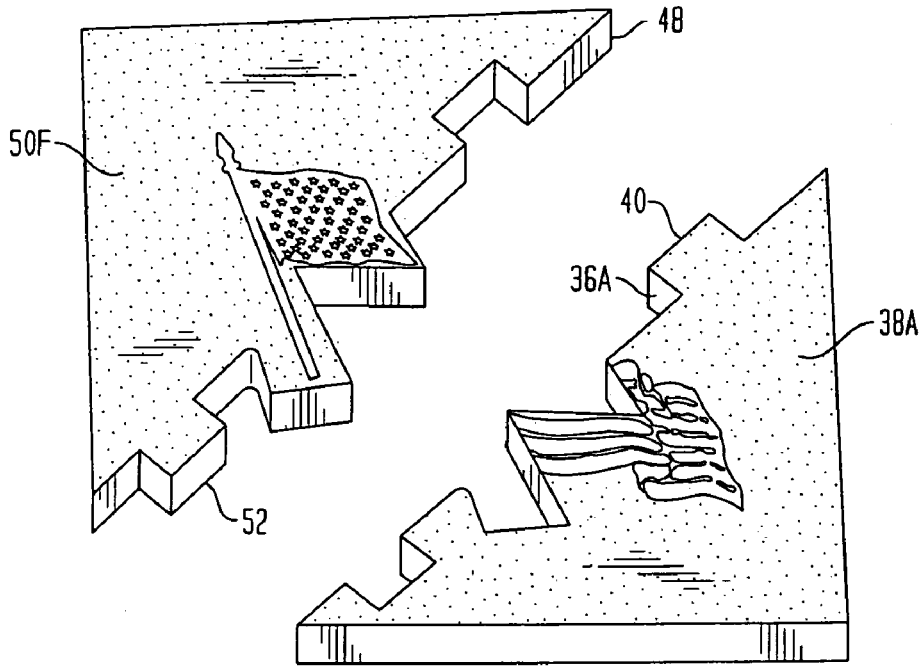
FIG. 9 shows a magnified view of the first and second marking structures of FIG. 5.

FIG. 9 shows first marking structure 38A placed adjacent second marking structure 50F so that the marking structures may be assembled together to form a combined marking structure for attachment to a hand stamp. The pattern 52 of edge 48 confronts the pattern 40 of edge 36A.

Figure 10:
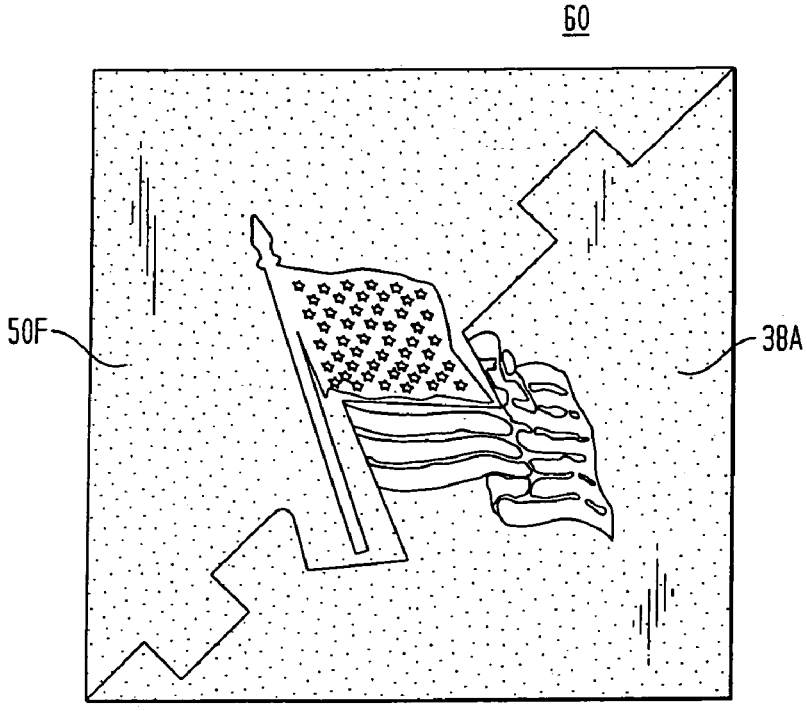
FIG. 10 shows the first and second marking structures of FIG. 9 assembled together to form a combined marking structure.

Referring to FIG. 10, the first marking structure 38A and second marking structure 50F are assembled together, whereby the patterned edges of the respective first and second marking structures 38A, 50F interlock with one another to form a unified marking structure 60. As noted above, in this particular preferred embodiment, a red ink is stored in first marking structure 38A and a blue ink is preferably stored in the second marking structure 50F. The non-porous edges between the first and second marking structures 38A, 50F prevent the blue and red ink from migrating into one another. In certain preferred embodiments, only one of the interlocking edges must be non-porous, while the other interlocking edge may remain porous. In these particular preferred embodiments, only one non-porous edge is needed to prevent ink migration. The combined marking structure 60 of FIG. 10 may then be assembled to a hand stamp mount by attaching the rear surface of the combined structure 60 with the mount, such as by using an adhesive.

Figure 11:
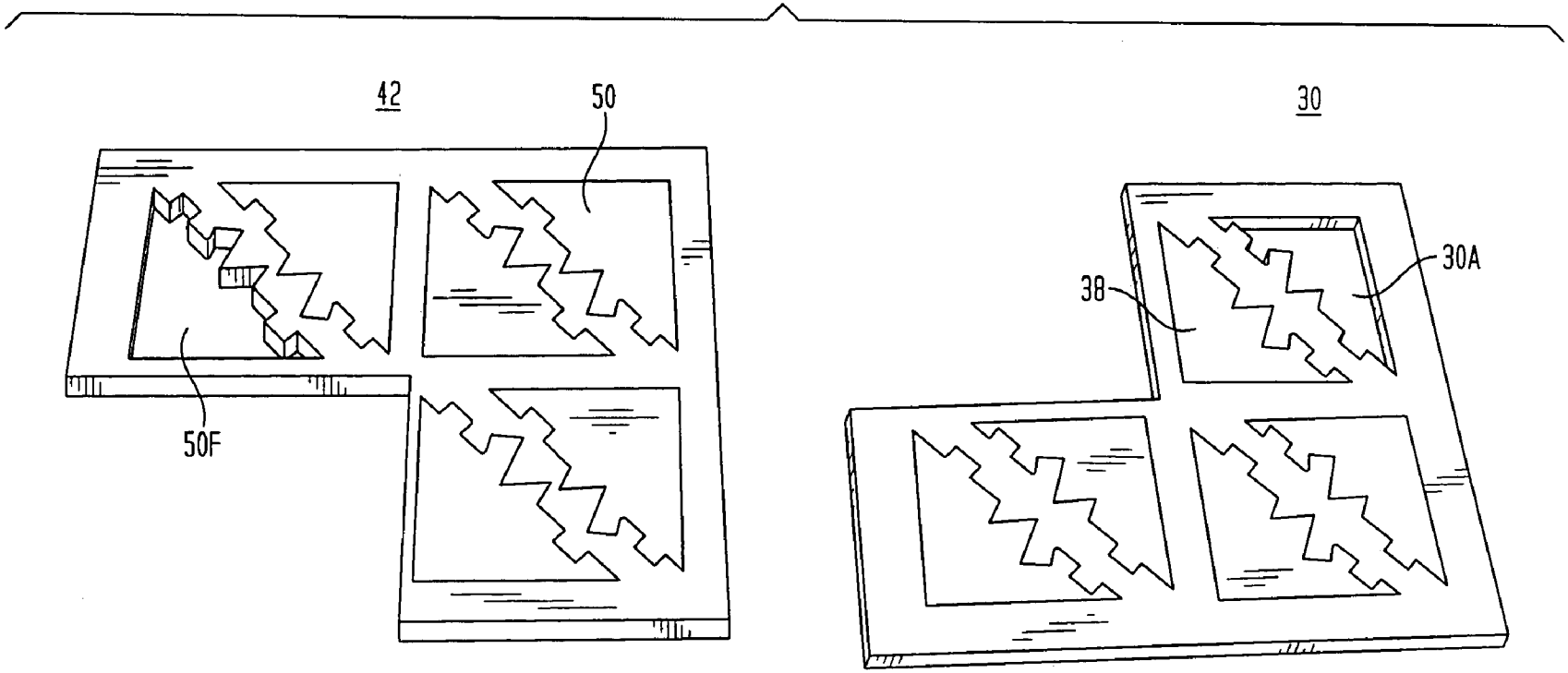
FIG. 11 shows a bottom view of first and second foam sheets having first and second marking structures formed therein, in accordance with certain preferred embodiments of the present invention.

FIGS. 11-14 show the rear surfaces of foam sheets having marking structures cut therein so that the interlocking patterned edges may be clearly seen. FIG. 11 shows the rear surface of first foam sheet 30 having first marking structures 38 cut therein and second foam sheet 42 having second marking structures 50 cut therein. As noted above, the bottom or rear surfaces of the respective first and second foam sheets 30, 42 are not exposed to light so that the respective surfaces remain substantially porous. During manufacture of the first and second marking structures 38, 50, an ink is introduced into the microporous foam body of the first and second marking structures 38, 50. When the face surfaces of the respective marking structures are pressed against a printable surface, the ink in the marking structures passes through the porous regions of the face surfaces for printing on printable surfaces.

Figure 12:
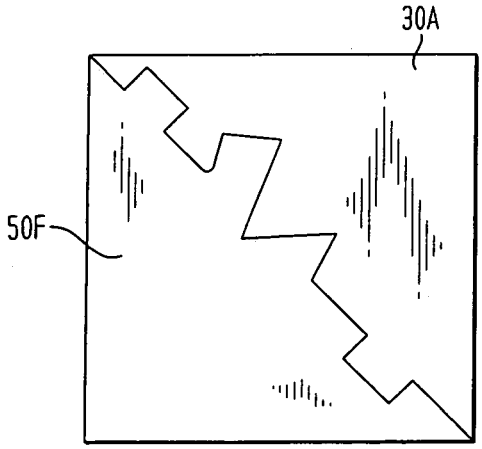
FIG. 12 shows a combined marking structure assembled from a first marking structure removed from the first foam sheet of FIG. 11 and a second marking structure removed from the second foam sheet of FIG. 11.

Referring to FIGS. 11 and 12, a first marking structure 38A is removed from first foam sheet 30 and a second marking structure 50F is removed from second foam sheet 42. The patterned edges of the opposing first and second marking structures 30A, 50F are then assembled with one another whereby the opposing projections and depressions interlock with one another similar to puzzle pieces. As such, the first and second marking structures 30A, 50F may only be assembled together in one configuration.

Figure 14:
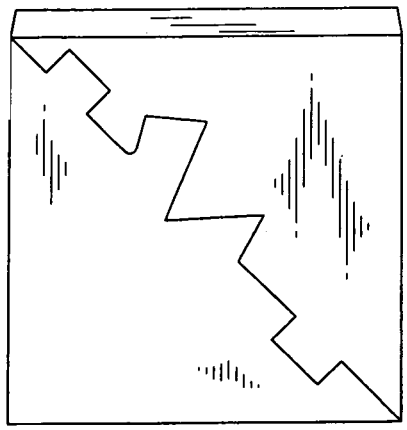
FIG. 14 shows the first and second marking structures of FIG. 13 after assembly into a combined marking structure.
Figure 13:
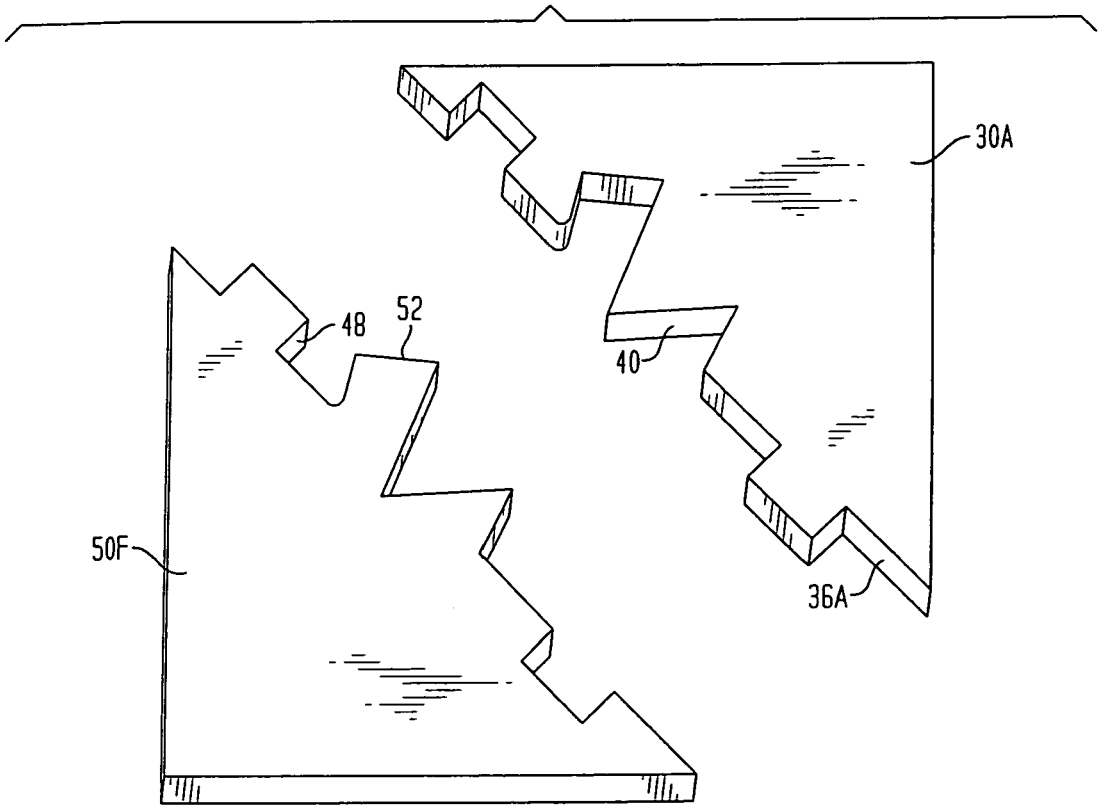
FIG. 13 shows a magnified view of the first and second marking structures of FIG. 12, prior to assembly.

FIG. 13 shows a magnified view of FIG. 12 prior to assembling the first marking structure 30A with the second marking structure 50F. First marking structure 30A has an edge 36A with a unique pattern 40. Second marking structure 50F also has an edge 48 with a unique pattern 52 cut therein. The opposing patterns 40, 52 match with one another so that the first and second marking structures 30A, 50F may be assembled together in only one configuration, thereby preventing improper assembly of the first and second marking structures 30A, 50F with one another. FIG. 14 shows first and second marking structures 30A and 50F assembled together.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of making an ink stamp, the method comprising:

providing a first porous structure having a top surface, a bottom surface and porous edges extending between said top and bottom surfaces;

loading a first ink into said first porous structure;

providing a second porous structure having a top surface, a bottom surface and porous edges extending between said top and bottom surfaces;

exposing the top surfaces of said first and second porous structures to a flash irradiation process to form a stamp pattern including non-porous and porous areas on the top surfaces;

loading a second ink into said second porous structure;

applying energy to one of the porous edges of said first porous structure to transform the porous edge to an edge having a non-porous surface; and assembling said first porous structure with said second porous structure so that the non-porous edge of said first porous structure is in direct contact with one of the edges of said second porous structure, wherein the non-porous edge prevents the first ink from passing through the non-porous edge to said second porous structure, non-porous edge of said first porous structure having a first pattern and the one of the edges of said second porous structure direct contact with the non-porous edge having a second pattern that matches the first pattern, the first pattern having a plurality of projections and a plurality of depressions, the second pattern having a plurality of projections and a plurality of depressions, the projections of the first pattern matching corresponding depressions of the second pattern, the projections of the second pattern matching correponding depressions of the first pattern, the assembling step including interlocking the first patterned edge of said first porous structure with the second patterned edge of said second porous structure, wherein said first and second porous structures can be assembled together in only one configuration.

2. The method as claimed in claim 1, further comprising before the assembling step applying energy to one of the porous edges of said second porous structure to transform the porous edge of said second porous structure to an edge having a non-porous surface, wherein the non-porous edge of said first porous structure is in direct contact with the non-porous edge of said second porous structure after the assembling step.

3. The method as claimed in claim 1, wherein said first and second porous structures comprise microporous foam.

4. The method as claimed in claim 1, wherein the first ink loaded into said first porous structure has a first color and the second ink loaded into said second porous structure has a second color that is different than the first color.

5. The method as claimed in claim 1, wherein the step of applying energy to one of the porous edges of said first porous structure comprises exposing the edge to a light source for forming the non-porous surface.

6. A method at making a multi-color ink stamp, the method comprising:

providing a first porous structure having a top surface; a bottom surface porous edges extending between said top and bottom surfaces and micropores exposed at said porous edges;

loading a first ink into said first porous structure;

exposing the top surface of said first porous structure to energy to form a stamp pattern including non-porous areas and porous areas;

providing a second porous structure having a top surface a bottom surface, porous edges extending between said top and bottom surfaces and micropores exposed at said porous edges of said second porous structure;

loading a second ink into said second porous structure;

applying energy to one of said porous edges of said first porous structure to close the micropores exposed at the one of said porous edges to form an edge having a non-porous surface; and assembling said first porous structure with said second porous structure so that said edge having the non-porous surface is in direct contact with one of the edges of said second porous structure, the non-porous edge of said first porous structure having a first pattern and the one of the edges of said second porous structure in direct contact with the non-porous edge having a second pattern that matches the first pattern, the first pattern having a plurality of projections and a plurality of depressions, the second pattern having a plurality of projections and a plurality of depressions, the projections of the first pattern matching corresponding depressions of the second pattern, the projections of the second pattern matching corresponding depressions of the first pattern, the assembling step including interlocking the first patterned edge of said first porous structure with the second patterned edge of said second porous structure, wherein said first and second porous structures can be assembled together in only one configuration.

7. The method as claimed in claim 6, wherein said non-porous surface of said first porous structure prevents the first ink from migrating to said second porous structure.

8. The method as claimed in claim 6, further comprising before the assembling step applying energy to one of the porous edges of said second porous structure to close the micropores exposed at the one of said porous edges to form an edge having a non-porous surface.

9. The method as claimed in claim 6, wherein said first and second porous structures comprise microporous foam.

10. The method as claimed in claim 6, wherein the applying energy step comprises exposing the pores exposed at one of the edges of said first porous structure to energy for melting the pores.

11. The method as claimed in claim 6, further comprising cutting said first porous structure from a first layer of porous material and cutting said second porous structure from a second layer of porous material.

12. The method as claimed in claim 6, wherein at least one of the interlocked first and second patterned edges has the non-porous surface for preventing ink migration between said first and second porous structures.

13. The method as claimed in claim 12, wherein both of the interlocked first and second patterned edges have non-porous surfaces.

14. The method as claimed in claim 6, wherein the exposing the top surface of said first porous structure to energy step comprises flash irradiating the top surface of said first porous structure.

15. A method of making an ink stamp, the method comprising:

providing a first porous structure adapted to carry ink, said first porous structure having a top surface, a bottom surface and porous edges extending between said top and bottom surfaces;

providing a second porous structure adapted to carry ink, said second porous structure having a top surface, a bottom surface and porous edges extending between said top and bottom surfaces;

applying energy to the top surfaces of said first and second porous structures to form stamp patterns including non-porous areas and porous areas;

applying energy to one of the porous edges of said first and second porous structures so that one of the edges of said first and second porous structures has a non-porous surface; and assembling said first porous structure with said second porous structure so that the edge having the non-porous surface is in direct contact with one of the edges of one of said first and second porous structures, the non-porous edge of said first porous structure having a first pattern and the one of the edges of said second porous structure in direct contact with the non-porous edge having a second pattern that matches the first pattern, the first pattern having a plurality of projections and a plurality of depressions, the second pattern having a plurality of projections and a plurality of depressions, the projections of the first pattern matching corresponding depressions of the second pattern, the projections of the second pattern matching corresponding depressions of the first pattern, the assembling step including interlocking the first patterned edge of said first porous structure with the second patterned edge of said second porous structure, wherein said first end second porous structures can be assembled together in only one configuration.

16. The method as claimed in claim 15, further comprising applying energy to at least one of the porous edges of said first porous structure and to at least one of the porous edges of said second porous structure so that both of the edges in contact with one another have non-porous surfaces.

17. The method as claimed in claim 15, further comprising providing a first ink in said first porous structure and a second ink in said second porous structure, wherein said first and second inks have different colors.

18. The method as claimed in claim 15, wherein the applying energy step comprises exposing the one of the porous edges to heat.

19. The method as claimed in claim 15, wherein the applying energy to the top surfaces of said first and second porous structures step comprises flash irradiating the cop surfaces of said first and second porous structures.

* * * * *

UNITED STATES PATENT AND TRADEMARK OFFICE

CERTIFICATE OF CORRECTION

PATENT NO. : 7,387,068 B2
APPLICATION NO. : 11/501658
DATED : June 17, 2008
INVENTOR(S) : Doogong Yip It is certified that error appears in the above-identified patent and that said Letters Patent is hereby corrected as shown below:

Column 8, line 49, before "non-porous", insert --the--.

Column 8, line 51, after "structure", insert --the--.

Column 9, line 17, after "surface", insert --,--.

Column 9, line 24, after "surface", insert --,--.

Column 10, line 47, "end" should read --and--.

Column 10, line 63, "cop" should read --top--.

Signed and Sealed this

Twenty-second Day of September, 2009

David J. Kappos

David J. Kappos
*Director of the United States Patent and Trademark Office*